US006730168B1

(12) United States Patent
Ross

(10) Patent No.: US 6,730,168 B1
(45) Date of Patent: May 4, 2004

(54) MAGNETIC SEALANT LINER APPLICATOR FOR APPLYING SEALANT TO VARIOUS SIZES OF METAL LIDS

(75) Inventor: Allan Ross, Englewood, CO (US)

(73) Assignee: Custom Machining Corp., Englewood, CO (US)

( * ) Notice: Subject to any disclaimer, the term of this patent is extended or adjusted under 35 U.S.C. 154(b) by 0 days.

(21) Appl. No.: 10/629,477

(22) Filed: Jul. 28, 2003

(51) Int. Cl.[7] ..... B05B 13/02

(52) U.S. Cl. ..... 118/319; 118/318; 118/314; 118/681

(58) Field of Search ..... 118/313, 314, 118/315, 318, 319, 320, DIG. 3, 681, 668, 679

(56) References Cited

U.S. PATENT DOCUMENTS

| | | | | |
|---|---|---|---|---|
| 3,898,954 A | * | 8/1975 | Galitz | 118/315 |
| 4,155,327 A | * | 5/1979 | Alexander et al. | 118/620 |
| 4,262,629 A | * | 4/1981 | McConnellogue et al. | 118/668 |
| 6,027,568 A | * | 2/2000 | Wallace et al. | 118/668 |

* cited by examiner

*Primary Examiner*—Richard Crispino
*Assistant Examiner*—Yewebdar T. Tadesse
(74) *Attorney, Agent, or Firm*—Edwin H. Crabtree; Ramon L. Pizorro; Donald W. Margolis

(57) ABSTRACT

A magnetic sealant liner applicator used for applying sealant to a plurality of metal lids. The applicator receiving the metal lids from an infeed conveyor and discharging the metal lids with sealant thereon to a discharge conveyor. The applicator includes a motor driven starwheel. The starwheel is mounted on top of a tabletop and driven in one direction. The starwheel has a plurality of cam followers spaced apart and extending outwardly from its circumference. The cam followers include cam follower bearings adapted for receiving a portion of individual metal lids thereagainst. A plurality of sealant guns are mounted on the starwheel. The sealant guns are under computer control and are disposed next to said cam followers. The sealant guns apply the sealant inside the metal lids. A motor driven magnetic wheel is mounted on top of the tabletop and disposed under the starwheel. The magnetic wheel is driven in an opposite direction from the starwheel. A circumference of the magnetic wheel is adapted for engaging a portion of the metal lids as the metal lids are spun on top of the tabletop.

20 Claims, 3 Drawing Sheets

MAGNETIC SEALANT LINER APPLICATOR FOR APPLYING SEALANT TO VARIOUS SIZES OF METAL LIDS

BACKGROUND OF THE INVENTION (a) Field of the Invention

This invention relates to a sealant liner applicator used for applying a sealant inside a metal jar lid and more particularly, but not by way of limitation, to a sealant liner applicator having a magnetic wheel and a starwheel used for high speed rotation of metal jar lids, steel can lids and the like and applying the sealant thereon.

(b) Discussion of Prior Art

Heretofore, there have been a variety of different types of sealant liner applicators using an upper and lower chuck for rotating metal lids or metal ends and applying a sealant thereon. These types of applicators require a large initial capital investment. Also, the equipment is complex and expensive to maintain. Further the changing of different lid sizes is complicated.

In U.S. Pat. No. 3,898,954 to Galitz, a complex compound applying machine is descrsibed. The machine includes two different oscillating members for alternate feeding of articles receiving a compound. In U.S. Pat. No. 5,564,877 to Hamilton, a turret liner machine is disclosed. The turret liner is used for applying a sealing compound to the end of cans. This type of applicator includes a spray mist system next to sealant injector nozzles. In U.S. Pat. Nos. 4,262,629 and 5,215,587 to McConnellogue et al., two different sealant applicators for can lids are described. The applicators are used in conjunction with a rotary chuck table. In U.S. Pat. No. 4,840,138 to Stirbis, a sealant supply system is illustrated having a plurality of rotatable sealant applying heads. In U.S. Pat. Nos. 6,113,333 and 6,547,878 to Rutledge et al., a rotating lift chuck with a plurality of sealant applying guns is disclosed.

None of the above mentioned prior art patents specifically disclose the unique features, structure and function of the subject magnetic sealant liner applicator as discussed herein.

SUMMARY OF THE INVENTION

In view of the foregoing, it is a primary objective of the subject invention to provide a highly reliable sealant liner applicator for applying sealant to metal lids at seeds in a range of 600 to 1500 lids per minute.

Another object of the invention is the initial capital investment cost of the subject invention is far less when compared to more complex sealant applicators currently on the market. Also, the magnetic sealant liner applicator requires fewer moving parts, requires fewer replacement parts and requires less maintenance with lower operating costs.

Yet another object of the applicator is to eliminate all chucks and a lower drive system used on similar equipment. The invention uses a novel magnetic wheel in conjunction with a starwheel for spinning the lids as a sealant gun applies sealant thereon.

Still anther object of the invention is the magnetic sealant liner applicator can be quickly changed for runs of different sizes of metal lids.

The magnetic sealant liner applicator includes a tabletop with a magnetic wheel drive motor and a starwheel drive motor mounted thereon. The starwheel drive motor is attached to a first drive belt. The first drive belt is attached to a drive pulley mounted on a bottom portion of a vertical drive shaft. The drive shaft is mounted on bearings attached to a center of the tabletop. A starwheel is attached to a top portion of the drive shaft The starwheel includes a plurality of cam followers mounted around the circumference thereof. Also, the starwheel includes a plurality of sealant guns disposed around the circumference and next to the cam followers. The guns are electrically connected to a computer mounted inside a rotary union. The rotary union is mounted on a center of a base plate. The base plate is mounted on top of the starwheel and centered thereon. The computer in the rotary union is programmed for turning the liners "on" and "off". When the guns are turned "on", sealant is applied to an inside of metal lids as they spin next to the circumference of the magnetic wheel. The metal lids ride in a semicircular lid track between an outer track guide and the circumference of the magnetic wheel. The magnetic wheel is disposed under the starwheel and is driven by a second drive belt attached to the magnetic wheel drive motor. The magnetic wheel drive motor drives the magnetic wheel in a clockwise direction. The starwheel drive motor drives the starwheel in a counterclockwise direction. In this manner, the metal lids are spun around the semicircular lid track as the sealant gun applys sealant thereon and before they exit the applicator.

These and other objects of the present invention will become apparent to those familiar with various types of sealant liner applicators used for applying sealant to metal lids when reviewing the following detailed description, showing novel construction, combination, and elements as herein described, and more particularly defined by the claims, it being understood that changes in the various embodiments of invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
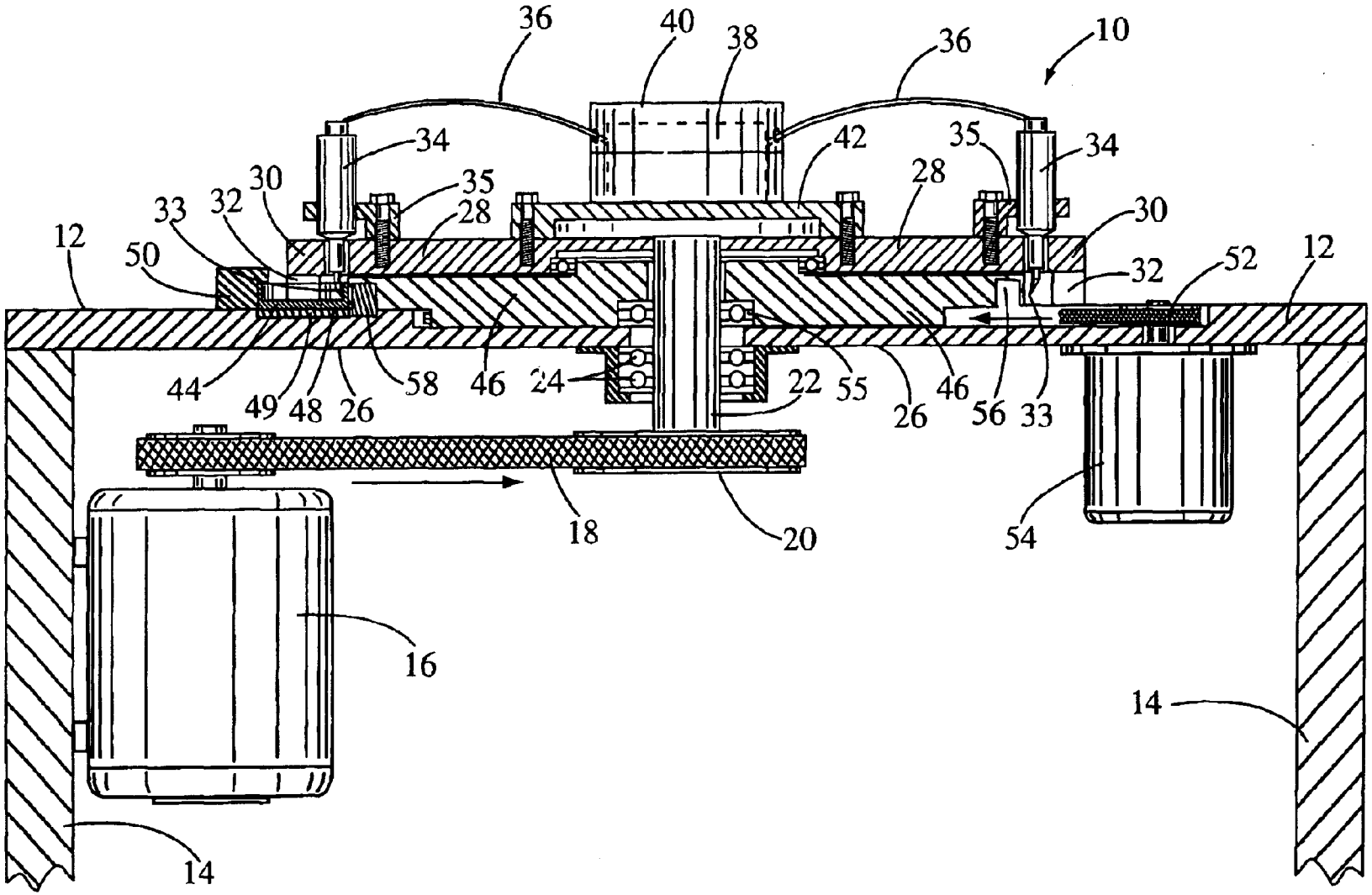
FIG. 1 is a side sectional view of the magnetic sealant liner applicator mounted on a tabletop. In this view, a front view of a pair of sealant guns is shown for applying sealant inside a plurality of metal lids.

In FIG. 1, a side sectional view of the subject magnetic sealant liner applicator is shown and having general reference numeral 10. The applicator 10 is shown mounted on a tabletop 12 having table legs 14. Mounted on one of the table legs 14 is a starwheel drive motor 16. The starwheel drive motor 16 is attached to a first drive belt 18. The first drive belt 18 is attached to a drive pulley 20 mounted on a bottom portion of a vertical drive shaft 22. The drive shaft 22 is mounted on bearings 24 attached to a bottom 26 of the tabletop 12.

Figure 2:
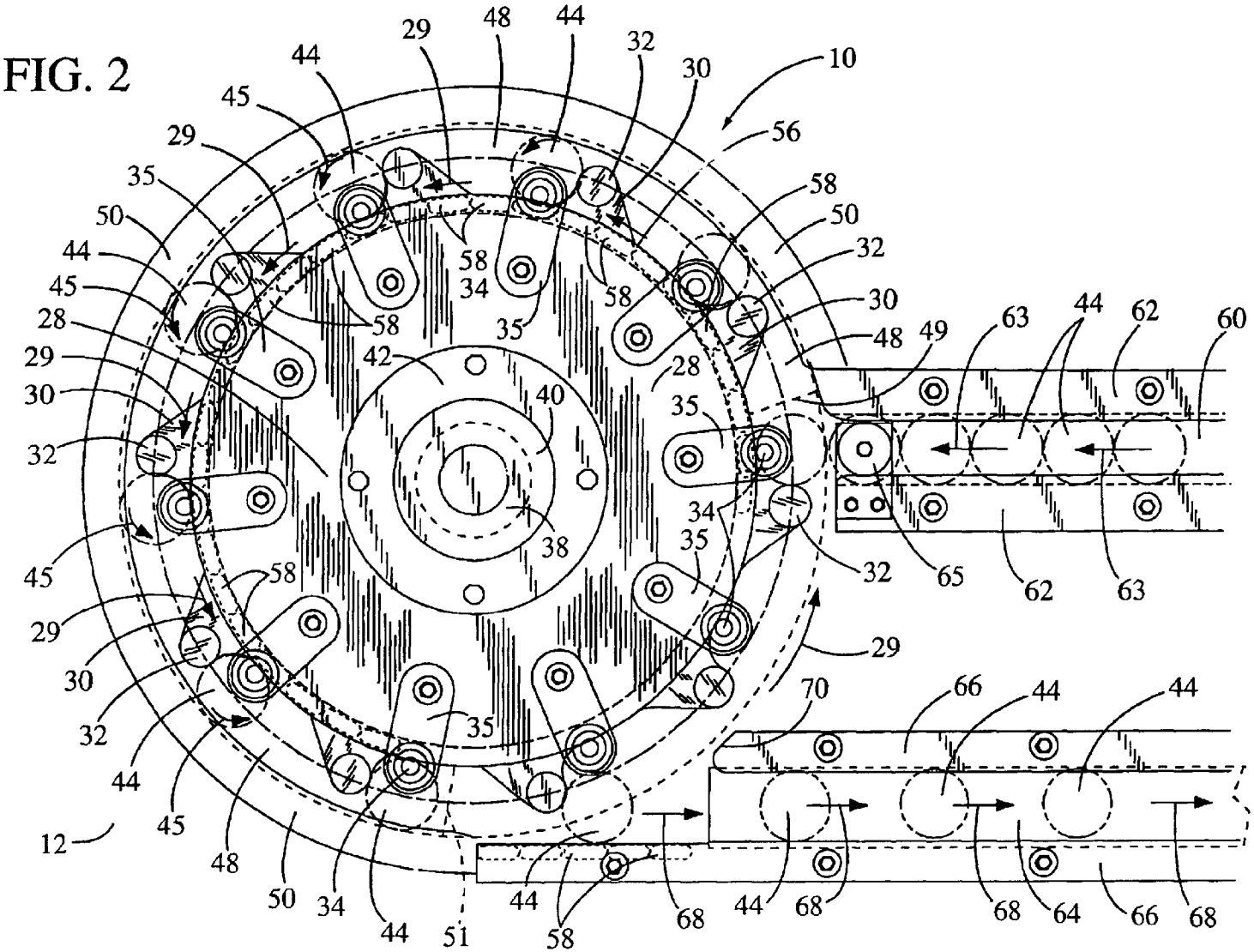
FIG. 2 is a top view of the magnetic sealant liner applicator and illustrating an infeed conveyor for introducing the metal lids in a semicircular lid track and next to a rotating magnetic wheel and a starwheel. A discharge conveyor is shown for receiving the metal lids with sealant thereon as they exit the applicator.
Figure 3:
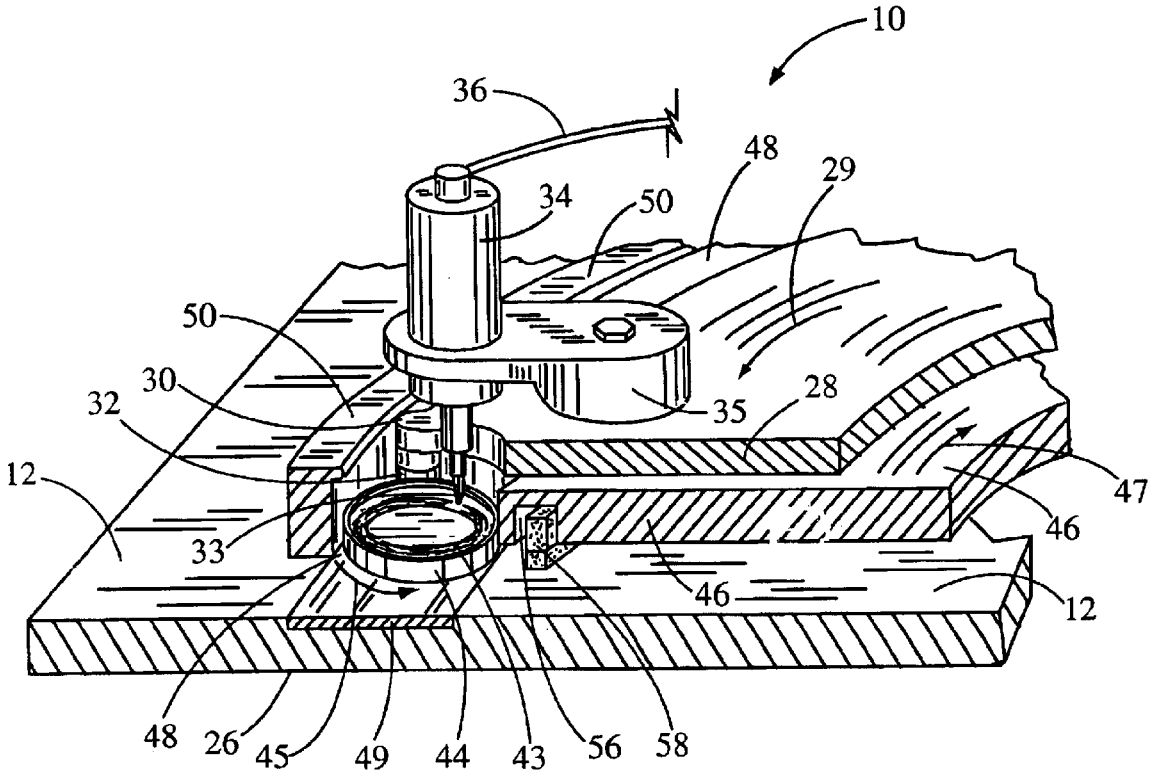
FIG. 3 is perspective view of a portion of the magnetic sealant liner applicator showing one of the sealant guns applying sealant around the inside of a metal lid. The metal lid is shown spinning in a counterclockwise direction and riding in the semicircular lid track. A portion of the metal lid is disposed next to the magnetic wheel.

A starwheel 28 is attached to a top portion of the drive shaft 22 and is driven in a counterclockwise direction, as shown by arrows 29. The arrows 29 are shown in FIGS. 2 and 3. The starwheel 28 includes a plurality of cam followers 30, with cam follower bearings 32, mounted around the circumference of the starwheel 28. Also, the starwheel includes a plurality of sealant guns 34 with spray nozzles 33 disposed around the circumference and next to the cam followers 30. The sealant guns 34 are attached to sealant gun brackets 35 mounted on top of the starwheel 28. The guns 34 are connected via electric leads 36 to a rotary union computer 38 mounted inside a rotary union 40. The rotary union computer 38 is shown in dashed lines. The rotary union 40 is mounted on a center of a base plate 42. The base plate 42 is attached to the top of the starwheel 28 and centered thereon.

The computer 38 in the rotary union 40 is programmed for turning the sealant guns 34 "on" and "off". When the guns 34 are turned "on", sealant 43 is applied from the spray nozzles 33 to an inside of metal lids 44 as they spin counterclockwise, as indicated by arrows 45, next to the circumference of a magnetic wheel 46. The arrows 45 are shown in FIGS. 2 and 3. The sealant 43 can be seen being applied inside one of the metal lids 44 in FIG. 3. The subject magnetic sealant gun application 10 can be programmed for high speed rotation for the handling and applying of the sealant 43 in a range of 600 to 1500 metal lids a minute. The metal lids 44 ride in a semicircular lid track 48 between an outer track guide 50 and the circumference of the magnetic wheel 46. The outer track guide 50 is mounted on the tabletop 12 and can be adjustable thereon. By adjusting the outer track guide 50, the width of the semicircular track 48 can be quickly adjusted for receiving different diameters of metal lids 44. Also, if the outer track guide 50 is not adjustable in width, the cam followers 30 can be adjustable around the circumference of the starwheel 28 for engaging and holding different diameter metal lids 44.

The semicircular track 48 can include a smooth surface, hard plastic, semicircular up ramp 49 starting at a 3 o'clock position and continuing in a counterclockwise direction to a 7 o'clock position. The up ramp 49 is designed to help move the metal lids 44 quickly and upwardly toward the spray nozzles 33 so that the sealant 43 can be properly applied next to the inside surface of the metal lids as shown in FIG. 3. At a roughly 7 o'clock position, the up ramp 49 turns into a down ramp 51. The down ramp 51 helps the metal lids 44 with the sealant 43 thereon move downwardly and quickly into the discharge conveyor 64.

The magnetic wheel 46 is disposed under the starwheel and is driven by a second drive belt 52 attached to a magnetic wheel drive motor 54. The magnetic wheel 46 is attached to the drive shaft 22 using a bearing 55. The drive motor 54 is mounted on the bottom 26 of the tabletop 12. The magnetic wheel drive motor 54 is used to drive the magnetic wheel 46 in a clockwise direction, as indicated by arrow 47. The arrow 47 is shown in FIG. 3. As mentioned above, the starwheel drive motor 16 drives the starwheel 28 in a counterclockwise direction. In this manner, the metal lids 44 are spun around the semicircular lid track 48 as the sealant guns 34 applies the sealant 43 thereon and before they exit the applicator 10.

The magnetic wheel 46 is magnetized by having a circular groove 56 in the bottom thereof and next to the circumference of the wheel 46. The groove 56 is adapted for receiving a plurality of magnets 58 therein. A bottom portion of the magnets 58 is embedded in the top of the tabletop 12. A top portion of the magnets 58 extend upwardly into the groove 56 and ride therein. This feature can be seen more clearly in FIG. 3. The magnets 58 are placed in a semicircular arc in the tabletop 12 extending from a 7 o'clock position to a 3 o'clock position as shown in FIG. 2.

In FIG. 2, a top view of the magnetic sealant gun applicator 10 is illustrated. In this drawing an infeed conveyor 60, with a pair of spaced apart infeed conveyor guides 62, is shown for introducing the metal lids 44, as indicated by arrows 63, into the semicircular lid track 48 and next to the rotating magnetic wheel 46 and the starwheel 28. The entrance of the metal lids 44 is controlled by an air operated stop gate 65. The air operated stop gate 65 is connected to the computer 38 for synchronizing the high speed control of the metal lids 44 entering the applicator 10 and making sure each lid is properly indexed next to the cam follower 30.

A discharge conveyor 64, with a pair of spaced apart discharge conveyor guides 66, is shown for receiving the metal lids 44 with the sealant 43 thereon as they exit the applicator 10. It should be noted that the magnetic wheel 46 is not disposed next to any magnets 58 in a 3 o'clock to 7 o'clock position. This feature allows the metal lids 44 to be released, using centrifugal force, from the side of the magnetic wheel 46 as the lids approach the discharge conveyor 64. Also, a rounded end 70 of the upper discharge conveyor guide 66 acts to help move the lids 44 onto the discharge conveyor 64, as indicated by arrows 68. Further, the lower discharge conveyor guide 66 can include magnets 58 for helping move the metal lids 44 into the discharge conveyor 64.

In FIG. 3, a perspective view of a portion of the magnetic sealant gun applicator 10 is illustrated In this drawing, one of the sealant guns 34 is shown applying sealant 43 around an inside of one of the metal lids 44. The metal lid 44 is shown spinning in a counterclockwise direction, as indicated by arrows 45, and riding in the semicircular lid track 48. A portion of the metal lid 44 is disposed next to the magnetic wheel 46 and held thereon with the magnetic force of the magnet 58 shown received inside the circular groove 56 in the bottom of the magnetic wheel 46.

While the magnets 58 are shown attached to the top of the tabletop 12 and riding in the circular groove 56, it should be mentioned that the magnetic wheel 46 can be magnetically charged electrically. Also the magnetic wheel 46 can be energized and controlled in any number of ways for holding the spinning metal lids 44 when applying the sealant 43 thereon.

While the invention has been particularly shown, described and illustrated in detail with reference to the preferred embodiments and modifications thereof, it should be understood by those skilled in the art that equivalent changes in form and detail may be made therein with departing from the true spirit and scope of the invention as claimed except as precluded by the prior art.

The embodiments of the invention for which as exclusive privilege and property right is claimed are defined as follows:

1. A magnetic sealant liner applicator used for applying sealant to a plurality of metal lids, the applicator receiving the metal lids from an infeed conveyor and discharging the metal lids with sealant thereon to a discharge conveyor, the applicator comprising:

a motor driven starwheel, said starwheel mounted on top of a tabletop, said starwheel driven in one direction, said starwheel having a plurality of cam followers spaced apart and extending outwardly from a circumference thereof, said cam followers adapted for receiving individual metal lids thereagainst;

at least one sealant gun mounted on said starwheel, said sealant gun under computer control, said sealant gun for applying the sealant on one of the metal lids; and a motor driven magnetic wheel, said magnetic wheel mounted on top of the tabletop and disposed next to said starwheel, said magnetic wheel driven in an opposite direction from said starwheel, a circumference of said magnetic wheel adapted for engaging a portion of the metal lids as the metal lids are spun on top of the tabletop.

2. The applicator as described in claim 1 further including a plurality of sealant guns under computer control, said sealant guns attached to sealant gun brackets, said sealant gun brackets mounted on said starwheel, whereby said sealant gun brackets are used for suspending said sealant guns next to the circumference of said starwheel.

3. The applicator as described in claim 1 further including a semicircular outer track guide mounted on the tabletop, said outer track guide disposed next to the circumferences of said starwheel and said magnetic wheel with a space therebetween, said space providing a semicircular lid track for receiving the metal lids thereon.

4. The applicator as described in claim 1 further including cam follower bearings mounted on each of said cam followers, said cam follower bearings adapted for engaging a portion of the metal lids as they are spun on top of the tabletop.

5. The applicator as described in claim 2 further including a rotary union mounted in a center of said starwheel, said rotary union housing a computer therein, said computer connected to each of said sealant guns and programmed for turning said guns "on" and "off" when applying sealant to the metal lids.

6. The applicator as described in claim 1 further including a plurality of magnets mounted in the top of the tabletop, an upper portion of said magnets received in a circular groove in a bottom of said magnetic wheel.

7. The applicator as described in claim 6 wherein said magnets are disposed in a semicircular shape on the tabletop.

8. A magnetic sealant liner applicator used for applying sealant to a plurality of metal lids, the applicator receiving the metal lids from an infeed conveyor and discharging the metal lids with sealant thereon to a discharge conveyor, the applicator comprising:

a motor driven starwheel, said starwheel mounted on top of a tabletop, said starwheel driven in one direction, said starwheel having a plurality of cam followers spaced apart and extending outwardly from a circumference thereof, said cam followers having cam follower bearings adapted for receiving a portion of individual metal lids thereagainst;

a plurality of sealant guns mounted on said starwheel, said sealant guns under computer control, said sealant guns disposed next to said cam followers, said sealant guns for applying the sealant inside the metal lids; and a motor driven magnetic wheel, said magnetic wheel mounted on top of the tabletop and disposed under said starwheel, said magnetic wheel driven in an opposite direction from said starwheel, a circumference of said magnetic wheel adapted for engaging a portion of the metal lids as the metal lids are spun on top of the tabletop.

9. The applicator as described in claim 8 further including a plurality of sealant gun brackets, said sealant gun brackets mounted on said starwheel, whereby said sealant gun brackets are used for suspending said sealant guns next to the circumference of said starwheel.

10. The applicator as described in claim 8 further including an adjustable semicircular outer track guide mounted on the tabletop, said outer track guide disposed next to the circumferences of said starwheel and said magnetic wheel with a space therebetween, said space providing a semicircular lid track which can be quickly adjusted for receiving different diameters of metal lids.

11. The applicator as described in claim 8 further including a semicircular up ramp disposed between an outer track guide mounted on the table top and next to the circumferences of said starwheel and said magnetic wheel, said up ramp adapted for receiving the metal lids thereon.

12. The applicator as described in claim 11 further including a semicircular down ramp disposed between said outer track guide and next to the circumferences of said starwheel and said magnetic wheel, said down ramp adapted for receiving the metal lids thereon.

13. The applicator as described in claim 8 further including a rotary union mounted in a center of said starwheel, said rotary union housing a computer therein, said computer connected to each of said sealant guns and programmed for turning said guns "on" and "off" when applying sealant to the metal lids.

14. The applicator as described in claim 8 further including a plurality of magnets adapted for mounted in the top of the tabletop, an upper portion of said magnets received in a circular groove in a bottom of said magnetic wheel.

15. A magnetic sealant liner applicator used for applying sealant to a plurality of metal lids, the applicator receiving the metal lids from an infeed conveyor and discharging the metal lids with sealant thereon to a discharge conveyor, the applicator comprising:

a motor driven starwheel, said starwheel mounted on top of a tabletop, said starwheel driven in one direction, said starwheel having a plurality of cam followers spaced apart and extending outwardly from a circumference thereof, said cam followers having cam follower bearings adapted for receiving a portion of individual metal lids thereagainst;

a plurality of sealant guns mounted on seal gun brackets attached to said starwheel, said sealant guns under computer control, said sealant guns disposed next to said cam followers, said sealant guns for applying the sealant inside the metal lids;

a motor driven magnetic wheel, said magnetic wheel mounted on top of the tabletop and disposed under said starwheel, said magnetic wheel driven in an opposite direction from said starwheel, a circumference of said magnetic wheel adapted for engaging a portion of the metal lids as the metal lids are spun on top of the tabletop; and a semicircular outer track guide mounted on the tabletop, said outer track guide disposed next to the circumferences of said starwheel and said magnetic wheel with a space therebetween, said space providing a semicircular lid track for guiding different diameters of metal lids thereon.

16. The applicator as described in claim 15 further including a semicircular up ramp made of hard plastic and disposed on said semicircular lid track between said outer track guide and next to the circumferences of said starwheel and said magnetic wheel.

17. The applicator as described in claim 16 further including a semicircular down ramp disposed on said semicircular lid track and between said outer track guide and next to the circumferences of said starwheel and said magnetic wheel.

18. The applicator as described in claim 15 further including a rotary union mounted in a center of said starwheel, said rotary union housing a computer therein, said computer connected to each of said sealant guns and programmed for turning said guns "on" and "off" when applying sealant to the metal lids.

19. The applicator as described in claim 15 further including a plurality of magnets adapted for mounted in the top of the tabletop, an upper portion of said magnets received in a circular groove in a bottom of said magnetic wheel.

20. The applicator as described in claim 15 wherein said cam followers are adjustable on said starwheel for engaging different diameter metal lids received on said semicircular lid track.

* * * * *